US008717257B2

(12) United States Patent
Kim

(10) Patent No.: US 8,717,257 B2
(45) Date of Patent: May 6, 2014

(54) SCAN DRIVER AND ORGANIC LIGHT EMITTING DISPLAY USING THE SAME

(75) Inventor: Dong-Hwi Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 361 days.

(21) Appl. No.: 13/006,255

(22) Filed: Jan. 13, 2011

(65) Prior Publication Data

US 2012/0062525 A1 Mar. 15, 2012

(30) Foreign Application Priority Data

Sep. 14, 2010 (KR) ..... 10-2010-0089946

(51) Int. Cl.
*G09G 3/30* (2006.01)

(52) U.S. Cl.
USPC ..... 345/76; 345/82; 315/169.3

(58) Field of Classification Search
USPC ..... 345/76–104, 204–215, 690–699; 315/169.1–169.4; 377/64–81
See application file for complete search history.

(56) References Cited

U.S. PATENT DOCUMENTS

| | | | | |
|---|---|---|---|---|
| 2004/0196239 | A1* | 10/2004 | Kwon | 345/92 |
| 2006/0227094 | A1* | 10/2006 | Park et al. | 345/100 |
| 2007/0018918 | A1* | 1/2007 | Chung | 345/76 |
| 2007/0040786 | A1* | 2/2007 | Chung | 345/92 |
| 2009/0040203 | A1* | 2/2009 | Kim et al. | 345/204 |
| 2009/0225068 | A1* | 9/2009 | Jeong et al. | 345/211 |

FOREIGN PATENT DOCUMENTS

| | | | |
|---|---|---|---|
| KR | 10-2007-0049906 | A | 5/2007 |
| KR | 10-2007-0100545 | A | 10/2007 |
| KR | 10-0805538 | B1 | 2/2008 |
| KR | 10-2008-0027062 | A | 3/2008 |
| KR | 10-2008-0033630 | A | 4/2008 |

* cited by examiner

*Primary Examiner* — Abbas Abdulselam
(74) *Attorney, Agent, or Firm* — Christie, Parker & Hale, LLP

(57) ABSTRACT

A scan driver includes a first signal processing unit for receiving a main input signal and a sub input signal to output a first output signal and a second output signal; a second signal processing unit for receiving the first output signal, the second output signal, and a clock signal to output a scan signal; and a third signal processing unit for receiving the first output signal and the second output signal to output an emission control signal.

11 Claims, 4 Drawing Sheets

SCAN DRIVER AND ORGANIC LIGHT EMITTING DISPLAY USING THE SAME

CROSS-REFERENCE TO RELATED APPLICATION

This application claims priority to and the benefit of Korean Patent Application No. 10-2010-0089946, filed on Sep. 14, 2010, in the Korean Intellectual Property Office, the entire content of which is incorporated herein by reference.

BACKGROUND

1. Field

The present invention relates to a scan driver and an organic light emitting display using the same.

2. Description of the Related Art

Cathode ray tubes (CRTs) have been used to display images. However, CRTs have the disadvantages of being heavy and large in size. Recently, various flat panel displays (FPDs) have been developed that are capable of reducing the heavier weight and larger volume that are the disadvantages of CRTs. Examples of FPDs include liquid crystal displays (LCDs), field emission displays (FEDs), plasma display panels (PDPs), and organic light emitting displays.

Organic light emitting displays can display images using organic light emitting diodes (OLEDs) that generate light by re-combination of electrons and holes. An organic light emitting display has a high response speed and can be driven with low power consumption. Common organic light emitting displays supply current corresponding to data signals to the OLEDs using transistors formed in pixels, so that light is emitted by the OLEDs.

A conventional organic light emitting display includes a data driver for supplying the data signals to data lines, a scan driver for sequentially supplying scan signals to scan lines, an emission control driver for supplying emission control signals to emission control lines, and a display unit including a plurality of pixels coupled to data lines, scan lines, and emission control lines.

When the scan signals are supplied to the scan lines, pixels included in the display unit are selected to receive the data signals from the data lines. The pixels that receive the data signals generate light (e.g., light components) with a corresponding (or predetermined) brightness level that corresponds to the data signals, and display an image (e.g., a predetermined image). Here, the emission times of light from the pixels are controlled by the emission control signals supplied through the emission control lines. In general, the emission control signals are supplied to coincide with (or overlap) the scan signals supplied to the scan lines, to set the pixels to which the data signals are supplied in a non-emission state.

Currently, research on setting the brightness of an organic light emitting display to be optimal is actively being performed. The brightness of a panel may be controlled by various methods. For example, a bit of data can be controlled to correspond to the amount of external light so that the brightness of the panel may be controlled. However, in order to control the bit of data, complicated processes are to be performed.

In addition, when an additional emission control driver is mounted in the panel in order to generate the emission control signals, a dead space of the display in which light emission does not occur, increases.

SUMMARY

According to exemplary embodiments of the present invention, a scan driver is capable of concurrently (e.g., simultaneously) generating scan signals and emission control signals and of freely controlling the width of the emission control signals, and an organic light emitting display using the same is provided.

An exemplary embodiment of the present invention provides a scan driver including a first signal processing unit for receiving a main input signal and a sub input signal to output a first output signal and a second output signal; a second signal processing unit for receiving the first output signal, the second output signal, and a clock signal to output a scan signal; and a third signal processing unit for receiving the first output signal and the second output signal to output an emission control signal.

The signal processing units may be coupled to a driving power source and a ground power source.

The first signal processing unit may include a first transistor having a gate electrode for receiving the sub input signal, a first electrode coupled to a first node, and a second electrode coupled to a ground power source; a second transistor having a gate electrode for receiving the main input signal, a first electrode coupled to the first node, and a second electrode coupled to a driving power source; a third transistor having a gate electrode coupled to the first node, a first electrode coupled to the driving power source, and a second electrode; a fourth transistor having a gate electrode coupled to the first node, a first electrode coupled to the second electrode of the third transistor, and a second electrode coupled to a second node; and a fifth transistor having a gate electrode for receiving the main input signal, a first electrode coupled to the second node, and a second electrode coupled to a ground power source, wherein the first output signal is output to the first node, and wherein the second output signal is output to the second node.

The second signal processing unit may include a first transistor having a gate electrode coupled to a first node of the first signal processing unit, a first electrode coupled to a driving power source, and a second electrode coupled to a third node; a second transistor having a gate electrode coupled to a second node of the first signal processing unit, a first electrode coupled to the third node, and a second electrode for receiving a clock signal; and a first capacitor coupled between the second node and the third node, wherein the scan signal is output to the third node.

The third signal processing unit may include a first transistor having a gate electrode coupled to a second node of the first signal processing unit, a first electrode coupled to a driving power source, and a second electrode coupled to a fourth node; a second transistor having a gate electrode coupled to a first node of the first signal processing unit, a first electrode coupled to the fourth node, and a second electrode coupled to a ground power source; and a first capacitor coupled between the first node and the fourth node, wherein an emission control signal is output to the fourth node.

According to another embodiment of the present invention, an organic light emitting display includes a display unit comprising pixels coupled to scan lines, emission control lines, data lines, a first power source, and a second power source; a scan driver comprising a plurality of stages coupled to the scan lines and the emission control lines to provide scan signals and emission control signals to the pixels through the scan lines and the emission control lines; and a data driver for supplying data signals to the pixels through the data lines, wherein each of the stages includes: a first signal processing unit for receiving a main input signal and a sub input signal to output a first output signal and a second output signal; a second signal processing unit for receiving the first output signal, the second output signal, and a clock signal to output a scan signal; and a third signal processing unit for receiving the first output signal and the second output signal to output an emission control signal.

Each of the signal processing units may be coupled to a driving power source and a ground power source.

The scan signal output from an ith stage may be configured to be supplied as the main input signal of an (i+1)th stage, wherein i is a natural number.

The first signal processing unit may include a first transistor having a gate electrode for receiving the sub input signal, a first electrode coupled to a first node, and a second electrode coupled to a ground power source; a second transistor having a gate electrode for receiving the main input signal, a first electrode coupled to the first node, and a second electrode coupled to a driving power source; a third transistor having a gate electrode coupled to the first node, a first electrode coupled to a driving power source, and a second electrode; a fourth transistor having a gate electrode coupled to the first node, a first electrode coupled to the second electrode of the third transistor, and a second electrode coupled to a second node; and a fifth transistor having a gate electrode for receiving the main input signal, a first electrode coupled to the second node, and a second electrode coupled to a ground power source, wherein the first output signal is output to the first node, and wherein the second output signal is output to the second node.

The second signal processing unit may include a first transistor having a gate electrode coupled to a first node of the first signal processing unit, a first electrode coupled to a driving power source, and a second electrode coupled to a third node; a second transistor having a gate electrode coupled to a second node of the first signal processing unit, a first electrode coupled to the third node, and a second electrode for receiving a clock signal; and a first capacitor coupled between the second node and the third node, wherein the scan signal is output to the third node.

The third signal processing unit may include a first transistor having a gate electrode coupled to a second node of the first signal processing unit, a first electrode coupled to a driving power source, and a second electrode coupled to a fourth node; a second transistor having a gate electrode coupled to a first node of the first signal processing unit, a first electrode coupled to the fourth node, and a second electrode coupled to a ground power source; and a first capacitor coupled between the first node and the fourth node, wherein an emission control signal is output to the fourth node.

As described above, according to embodiments of the present invention, a scan driver capable of concurrently (e.g., simultaneously) generating scan signals and emission control signals and of freely controlling the width of the emission control signals, and an organic light emitting display using the same may be provided.

BRIEF DESCRIPTION OF THE DRAWINGS

The accompanying drawings, together with the specification, illustrate exemplary embodiments of the present invention, and, together with the description, serve to explain principles of embodiments of the present invention.

DETAILED DESCRIPTION

Figure 1:
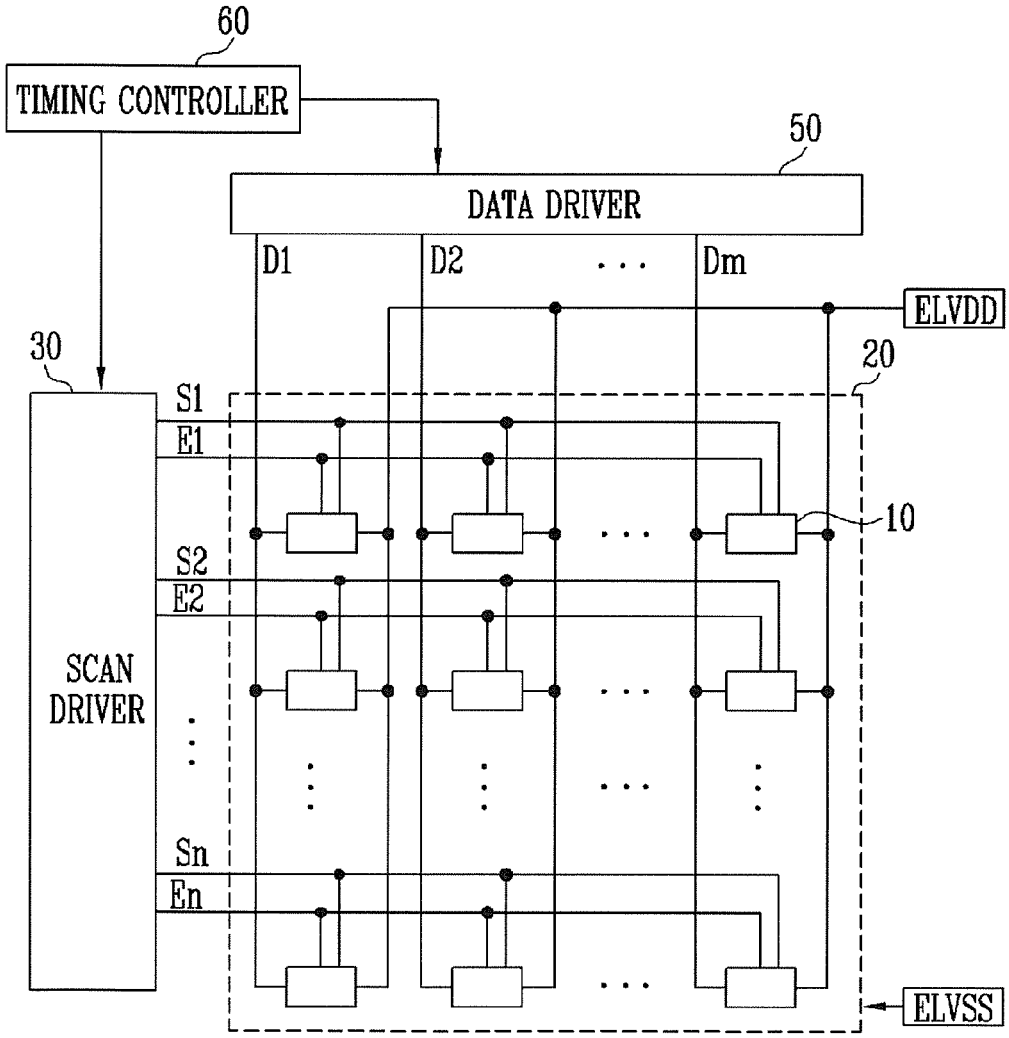
FIG. 1 is a block diagram (or view) illustrating an organic light emitting display according to an exemplary embodiment of the present invention.

A method of controlling the width of the emission control signals to control the brightness of the panel has been provided to address the issue of brightness control. Since a turn-on time of pixels can be controlled to correspond to the width of the emission control signals, the width of the emission control signals can be controlled so that the brightness of the panel may be controlled. Therefore, an emission control driver capable of controlling (e.g., freely controlling) the width of the emission control signals is desirable.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity. Also, like reference numerals refer to like elements throughout.

Aspects (e.g., specific descriptions) of other embodiments are included in the detailed description and drawings.

The aspects and characteristics of the present invention and a method of achieving the aspects and characteristics of the present invention will be described (or clarified) with reference to the embodiments described hereinafter in detail, together with the accompanying drawings. However, the present invention is not limited to the embodiments disclosed hereinafter and may be realized in different forms. When a part is described as being coupled to another part, the part may be electrically coupled to the other part with another element interposed between them, or the part may be directly coupled to the other part. In addition, in the drawings, some of the parts that are not necessary for a complete understanding of the present invention are omitted for clarity. The same reference numerals in different drawings represent the same element.

Hereinafter, embodiments of the present invention will be described with reference to the accompanying drawings.

FIG. 1 is a block diagram (or view) illustrating an organic light emitting display according to an exemplary embodiment of the present invention.

Referring to FIG. 1, the organic light emitting display according to an exemplary embodiment of the present invention includes a display unit 20 including pixels 10 coupled to scan lines S1 to Sn, emission control lines E1 to En, data lines D1 to Dm, and a first power source ELVDD and a second power source ELVSS; a scan driver 30 for supplying scan signals to the pixels 10 through the scan lines S1 to Sn and for supplying emission control signals to the pixels 10 through the emission control lines E1 to En; and a data driver 50 for supplying data signals to the pixels 10 through the data lines D1 to Dm. The organic light emitting display may further include a timing controller 60 for controlling the scan driver 30 and the data driver 50.

The scan driver 30 generates scan signals according to (or by) the control of the timing controller 60 and sequentially supplies the generated scan signals to the scan lines S1 to Sn. Then, the pixels 10 coupled to the scan lines S1 to Sn may be sequentially selected.

In addition, the scan driver 30 generates emission control signals according to (or by) the control of the timing controller 60 and supplies the generated emission control signals to the emission control lines E1 to En.

The data driver 50 generates data signals, which determine the emission brightness levels (or brightness components) of the pixels 10, according to (or by) the control of the timing controller 60, and supplies the generated data signals to the data lines D1 to Dm. Then, the data signals are supplied to the pixels 10 selected by the scan signals and the selected pixels 10 emit light (or light components) with brightness levels (or brightness components) corresponding to the data signals supplied thereto.

Figure 2:
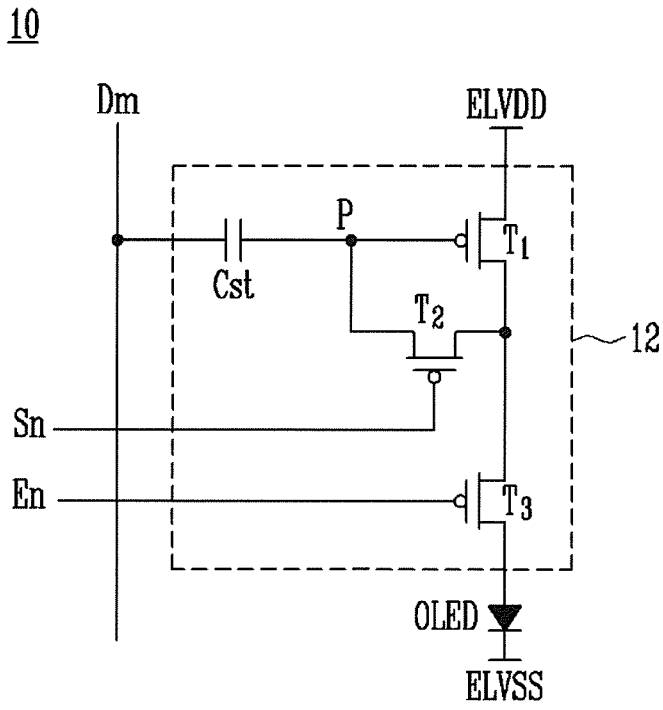
FIG. 2 is a circuit diagram (or view) illustrating a pixel of the organic light emitting display illustrated in FIG. 1 according to an exemplary embodiment of the present invention.

FIG. 2 is a circuit diagram (or view) illustrating a pixel according to an exemplary embodiment of the present invention. In FIG. 2, for the sake of convenience, a pixel coupled to an nth scan line Sn and an mth data line Dm will be illustrated.

The pixels 10 are coupled to the first power source ELVDD and the second power source ELVSS in order to generate light (or light components) corresponding to the data signals. The first power source ELVDD may be a high potential power source and the second power source ELVSS may be a low potential power source (for example, a ground power source) having a voltage at a lower level than the voltage of the first power source ELVDD.

Referring to FIG. 2, each of the pixels 10 includes a pixel circuit 12 coupled to an organic light emitting diode OLED, a data line Dm, and a scan line Sn, to control the amount of current supplied to the OLED.

The anode electrode of the OLED is coupled to the pixel circuit 12 and the cathode electrode is coupled to the second power source ELVSS. The OLED generates light with a corresponding (or predetermined) brightness level to correspond to the current supplied from the pixel circuit 12.

The pixel circuit 12 controls the current that flows from the first power source ELVDD to the second power source ELVSS via the OLED, in response to the data signal supplied to the data line Dm when a scan signal is supplied to the scan line Sn.

The pixel circuit 12 includes first to third transistors T1 to T3 and a storage capacitor Cst.

The first transistor T1 is a driving transistor that generates current having a level corresponding to the voltage level applied (or loaded) between a gate electrode and a first electrode of the first transistor T1, to supply the generated current to the OLED.

Therefore, the first electrode of the first transistor T1 is coupled to the first power source ELVDD, the second electrode of the first transistor T1 is coupled to the second electrode of the second transistor T2, and the gate electrode of the first transistor T1 is coupled to a node P.

The first electrode of the second transistor T2 is coupled to the node P, the second electrode of the second transistor T2 is coupled to the second electrode of the first transistor T1, and the gate electrode of the second transistor T2 is coupled to the scan line Sn.

In addition, the second transistor T2 is turned on when the scan signal is supplied from the scan line Sn, to electrically couple the node P to the second electrode of the first transistor T1.

The first electrode of the third transistor T3 is coupled to the second electrode of the first transistor T1, the second electrode of the third transistor T3 is coupled to the anode electrode of the OLED, and the gate electrode of the third transistor T3 is coupled to a control line En.

In addition, the third transistor T3 is turned off when an emission control signal is supplied from the control line En, to block coupling between the second electrode of the first transistor T1 and the anode electrode of the OLED.

The emission control signal turns off the third transistor T3. When the third transistor T3 is a PMOS transistor as illustrated in FIG. 2, a high level voltage is applied to turn off the third transistor T3. When the third transistor T3 is an NMOS transistor, a low level voltage is applied to turn off the third transistor T3.

A first terminal of the storage capacitor Cst is coupled to the data line Dm and a second terminal of the storage capacitor Cst is coupled to the node P.

The anode electrode of the OLED is coupled to the second electrode of the third transistor T3 and the cathode electrode of the OLED is coupled to the second power source ELVSS so that light corresponding to the driving current generated by the first transistor T1 can be generated.

The node P is a contact point at which the gate electrode of the first transistor T1, the second terminal of the storage capacitor Cst, and the first electrode of the second transistor T2 are coupled to each other.

The above-described pixel circuit structure of FIG. 2 is only one embodiment of the present invention, and the pixel 10 (shown in FIG. 1) of the present invention is not limited to the pixel circuit structure shown in FIG. 2.

Figure 3:
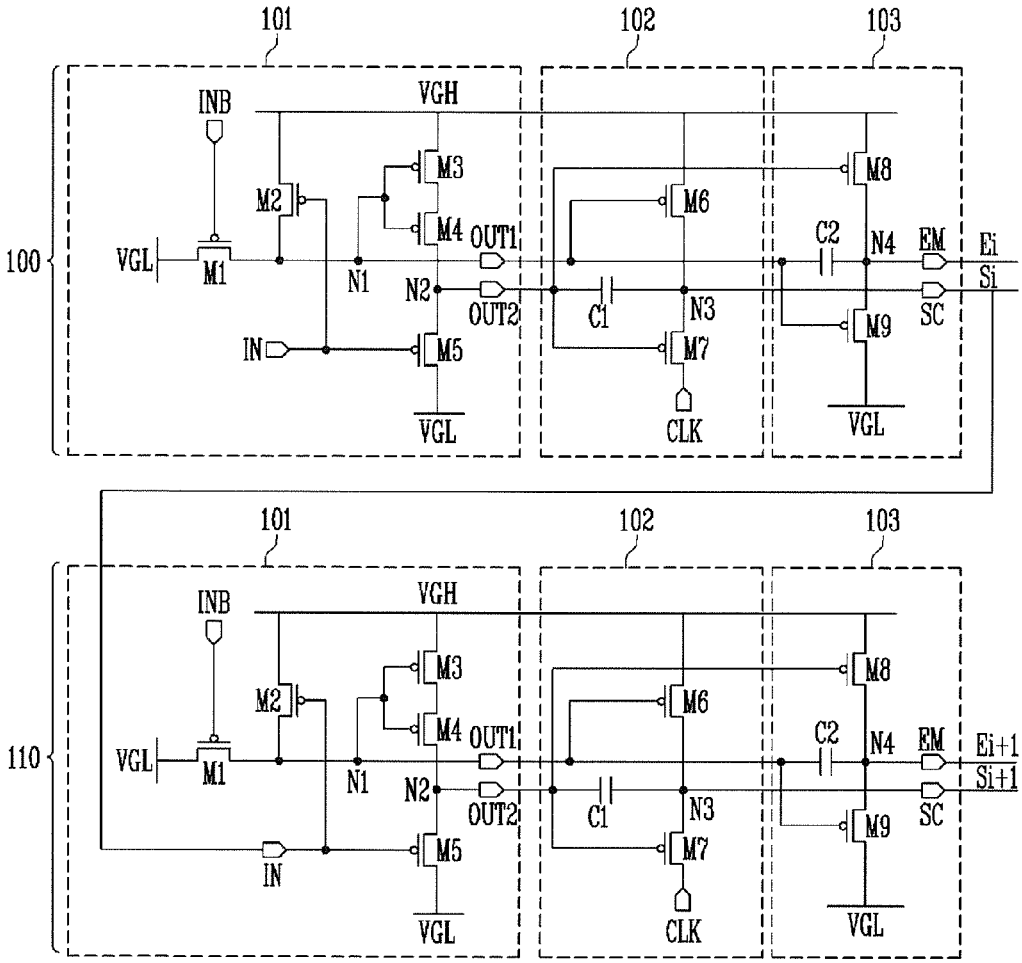
FIG. 3 is a schematic diagram (or view) illustrating a scan driver of the organic light emitting display illustrated in FIG. 1 according to an exemplary embodiment of the present invention.

FIG. 3 is a schematic diagram (or view) illustrating a scan driver of the organic light emitting display illustrated in FIG. 1 in more detail, according to an exemplary embodiment of the present invention. In FIG. 3, for the sake of convenience, an ith (i is a natural number) stage and an (i+1)th stage are illustrated.

The scan driver 30 generates the scan signals SC and the emission control signals EM and supplies the generated signals to the scan lines S1 to Sn and the emission control lines E1 to En. The timing controller 60 supplies various signals such as a main input signal IN, a sub input signal INB, and a clock signal CLK to the scan driver 30.

The scan driver 30 includes a plurality of stages coupled to the scan lines S1 to Sn and the emission control lines E1 to En. For example, as illustrated in FIG. 3, an ith stage 100 is coupled to an ith scan line Si and an ith control line Ei, and an (i+1)th stage 110 is coupled to an (i+1)th scan line Si+1 and an (i+1)th control line Ei+1.

Each of the stages includes a first signal processing unit 101, a second signal processing unit 102, and a third signal processing unit 103 in order to output the scan signals SC and the emission control signals EM. The ith stage 100 will be representatively described.

The first signal processing unit 101 receives the main input signal IN and the sub input signal INB to output a first output signal OUT1 and a second output signal OUT2.

The second signal processing unit 102 receives the first output signal OUT1, the second output signal OUT2, and the clock signal CLK to output the scan signals SC.

The third signal processing unit 103 receives the first output signal OUT1 and the second output signal OUT2 to output the emission control signals EM.

The signal processing units 101, 102, and 103 are coupled to a driving power source VGH, and the signal processing units 101 and 103 are coupled to a ground power source VGL. The driving power source VGH has a high level voltage and the ground power source VGL has a lower level voltage (for example, a ground power source) than the driving power source VGH.

The first signal processing unit 101 includes first to fifth transistors M1 to M5 in order to output the first output signal OUT1 and the second output signal OUT2.

The gate electrode of the first transistor M1 receives the sub input signal INB, the first electrode of the first transistor M1 is coupled to a first node N1, and the second electrode of the first transistor M1 is coupled to a ground power source VGL. When the sub input signal INB is supplied, the first transistor M1 is turned on to apply the ground power source VGL to the first node N1.

The sub input signal INB for turning on the first transistor M1 has a low level voltage when the first transistor M1 is a PMOS transistor as illustrated in FIG. 3, and has a high level voltage when the first transistor M1 is an NMOS transistor.

The gate electrode of the second transistor M2 receives the main input signal IN, the first electrode of the second transistor M2 is coupled to the first node N1, and the second electrode of the second transistor M2 is coupled to the driving power source VGH. When the main input signal IN is supplied, the second transistor M2 is turned on to apply (or transmit) the driving power source VGH to the first node N1.

The gate electrode of the third transistor M3 is coupled to the first node N1, the first electrode of the third transistor M3 is coupled to the driving power source VGH, and the second electrode of the third transistor M3 is coupled to the first electrode of a fourth transistor M4.

The gate electrode of the fourth transistor M4 is coupled to the first node N1, the first electrode of the fourth transistor M4 is coupled to the second electrode of the third transistor M3, and the second electrode of the fourth transistor M4 is coupled to a second node N2.

When the third transistor M3 and the fourth transistor M4 are PMOS transistors as illustrated in FIG. 3, the third transistor M3 and the fourth transistor M4 are turned on by the ground power source VGL having a low level voltage and turned off by the driving power source VGH having a high level voltage. Once turned on, the third transistor M3 and the fourth transistor M4 apply (or transmit) the driving power source VGH to the second node N2.

The gate electrode of a fifth transistor M5 receives the main input signal IN, the first electrode of the fifth transistor M5 is coupled to the second node N2, and the second electrode of the fifth transistor M5 is coupled to the ground power source VGL. When the main input signal IN is supplied, the fifth transistor M5 is turned on to apply (or transmit) the ground power source VGL to the second node N2.

The main input signal IN for turning on the second transistor M2 and the fifth transistor M5 has a low level voltage when the transistors M2 and M5 are PMOS transistors as illustrated in FIG. 3, and has a high level voltage when the transistors M2 and M5 are NMOS transistors.

The first signal processing unit 101 outputs the first output signal OUT1 to the first node N1 to supply the first output signal OUT1 to the second signal processing unit 102 and the third signal processing unit 103. The first signal processing unit 101 outputs the second output signal OUT2 to the second node N2 to supply the second output signal OUT2 to the second signal processing unit 102 and the third signal processing unit 103.

The ground power source VGL or the driving power source VGH may be output as the first output signal OUT1 or the second output signal OUT2.

The second signal processing unit 102 includes sixth and seventh transistors M6 and M7 (which may be referred to as first and second transistors) and a first capacitor C1 in order to output the scan signals SC.

The gate electrode of the sixth transistor M6 is coupled to the first node N1, the first electrode of the sixth transistor M6 is coupled to the driving power source VGH, and the second electrode of the sixth transistor M6 is coupled to a third node N3. The sixth transistor M6 is turned on when the ground power source VGL is supplied to the first node N1 and is turned off when the driving power source VGH is supplied to the first node N1. Once turned on, the sixth transistor M6 applies (or transmits) the driving power source VGH to the third node N3.

The gate electrode of the seventh transistor M7 is coupled to the second node N2, the first electrode of the seventh transistor M7 is coupled to the third node N3, and the second electrode of the seventh transistor M7 receives the clock signal CLK. When the ground power source VGL is supplied to the second node N2, the seventh transistor M7 is turned on to transmit the clock signal CLK to the third node N3, and is turned off when the driving power source VGH is supplied to the second node N2.

A first capacitor C1 is coupled between the second node N2 and the third node N3.

The second signal processing unit 102 outputs the scan signal SC to the third node N3. The output scan signal SC is supplied to the ith scan line Si. In addition, the scan signal SC is supplied as the main input signal IN of the next stage. That is, the scan signal SC output from the ith stage 100 is input as the main input signal IN to the first signal processing unit 101 of the (i+1)th stage 110.

The third signal processing unit 103 includes eighth and ninth transistors M8 and M9 (which may be referred to as first and second transistors) and a second capacitor C2 (which may be referred to as a first capacitor) in order to output the emission control signal EM.

The gate electrode of the eighth transistor M8 is coupled to the second node N2, the first electrode of the eighth transistor M8 is coupled to the driving power source VGH, and the second electrode of the eighth transistor M8 is coupled to a fourth node N4. When the ground power source VGL is supplied to the second node N2, the eighth transistor M8 is turned on to apply (or transmit) the driving power source VGH to the fourth node N4, and is turned off when the driving power source VGH is supplied to the second node N2.

The gate electrode of the ninth transistor M9 is coupled to the first node N1, the first electrode of the ninth transistor M9 is coupled to the fourth node N4, and the second electrode of the ninth transistor M9 is coupled to the ground power source VGL. When the ground power source VGL is supplied to the first node N1, the ninth transistor M9 is turned on to apply (or transmit) the ground power source VGL to the fourth node N4, and is turned off when the driving power source VGH is supplied to the first node N1.

The second capacitor C2 is coupled between the first node N1 and the fourth node N4.

The third signal processing unit 103 outputs the emission control signal EM to the fourth node N4 and the output emission control signal EM is supplied to the ith control line Ei.

The first node N1 is a contact point of the first electrode of the first transistor M1, the first electrode of the second transistor M2, the gate electrode of the third transistor M3, the gate electrode of the fourth transistor M4, the gate electrode of the sixth transistor M6, the gate electrode of the ninth transistor M9, and one terminal (e.g., a first terminal) of the second capacitor C2.

The second node N2 is a contact point of the second electrode of the fourth transistor M4, the first electrode of the fifth transistor M5, the gate electrode of the seventh transistor M7, the gate electrode of the eighth transistor M8, and one terminal (e.g., a first terminal) of the first capacitor C1.

The third node N3 is a contact point of the second electrode of the sixth transistor M6, the first electrode of the seventh transistor M7, and the other terminal (e.g., a second terminal) of the first capacitor C1.

The fourth node N4 is a contact point of the second electrode of the eighth transistor M8, the first electrode of the ninth transistor M9, and the other terminal (e.g., a second terminal) of the second capacitor C2.

It is well known to those skilled in the art that the above-described first to ninth transistors M1 to M9 may be realized as NMOS transistors in other embodiments, instead of PMOS transistors.

Figure 4:
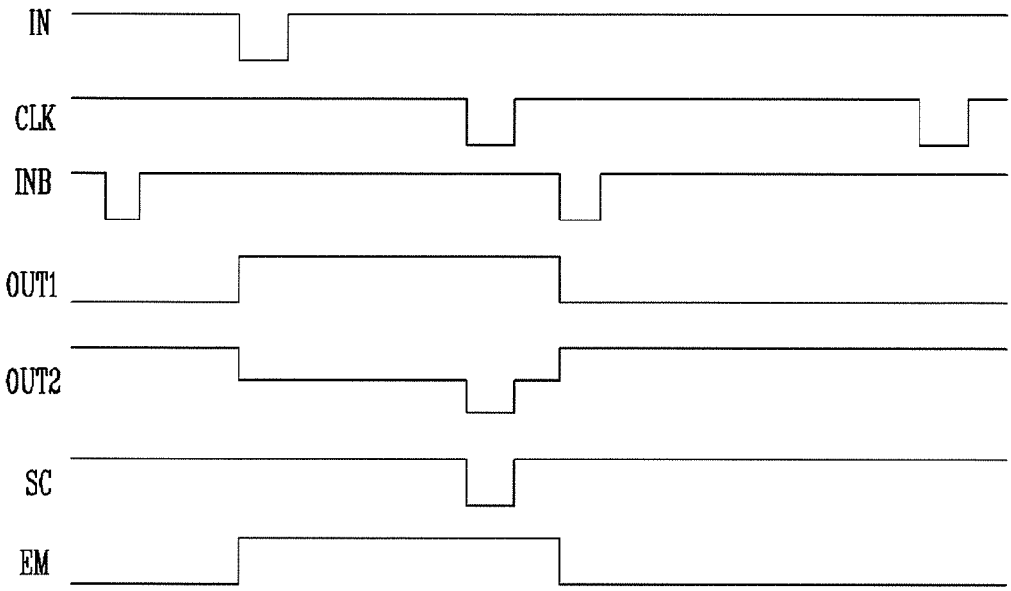
FIG. 4 is a timing diagram (or waveform chart) illustrating the operation of the scan driver of FIG. 3.

FIG. 4 is a timing diagram (or waveform chart) illustrating the operation of the scan driver of FIG. 3. With reference to FIGS. 3 and 4, the operations of signal processing units will be described.

First, when the sub input signal INB is supplied while the low level ground power source VGL is supplied, the first transistor M1 is turned on and the ground power source VGL is applied to the first node N1. At this time, since the main input signal IN is not being supplied, the second transistor M2 and the fifth transistor M5 are turned off.

When the ground power source VGL (i.e., ground power VGL) is supplied to the first node N1, the third transistor M3 and the fourth transistor M4 are turned on so that the driving power source VGH (i.e., driving power VGH) is applied to the second node N2.

When the low level ground power source VGL is supplied to the first node N1, the sixth transistor M6 is turned on so that the driving power source VGH is applied to the third node N3, and the ninth transistor M9 is turned on so that the ground power source VGL is applied to the fourth node N4.

Therefore, the ground power source VGL is output as the first output signal OUT1 and the emission control signal EM, and the driving power source VGH is output as the second output signal OUT2 and the scan signal SC.

Then, the main input signal IN is supplied, the second transistor M2 is turned on so that the driving power source VGH is applied to the first node N1 and the fifth transistor M5 is turned on so that the ground power source VGL is applied to the second node N2.

Therefore, the driving power source VGH applied to the first node N1 is output as the first output signal OUT1.

The driving power source VGH is applied to the first node N1 so that the third transistor M3, the fourth transistor M4, the sixth transistor M6, and the ninth transistor M9 are turned off.

In addition, the ground power source VGL is applied to the second node N2 so that the seventh transistor M7 and the eighth transistor M8 are turned on and so that the ground power source VGL is output as the second output signal OUT2.

The seventh transistor M7 is turned on so that the clock signal CLK is applied to the third node N3 and the clock signal CLK is output as the scan signal SC.

The eighth transistor M8 is turned on so that the driving power source VGH is applied to the fourth node N4 and so that the driving power source VGH is output as the emission control signal EM.

When the clock signal CLK is transitioned from a high level to a low level while the high level emission control signal EM is being output, the voltage of the third node N3 is reduced so that the voltage of the scan signal SC is reduced by the amount of voltage drop of the clock signal CLK.

Therefore, the scan signal SC transitioned to a low level is supplied to the ith scan line Si and is supplied as the main input signal IN of the next stage.

When the sub input signal INB is supplied at a low level while the emission control signal EM is output, the ground power source VGL will be output as the emission control signal EM, and therefore the emission control signal EM will have a low level voltage.

Therefore, the width of the emission control signals EM (the width of high level voltages of the emission control signals EM) may be controlled (e.g., freely controlled) using the main input signal IN and the sub input signal INB, and the scan signals SC may be output.

Although the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A scan driver comprising:

a first signal processing unit for receiving a main input signal and a sub input signal to output a first output signal and a second output signal, wherein each of the first and second output signals is generated according to both of the main input signal and the sub input signal;

a second signal processing unit for receiving the first output signal, the second output signal, and a clock signal to output a scan signal; and a third signal processing unit for receiving the first output signal and the second output signal to output an emission control signal, wherein a width of the emission control signal is controlled using the main input signal and the sub input signal.

2. The scan driver as claimed in claim 1, wherein the signal processing units are coupled to a driving power source and a ground power source.

3. The scan driver as claimed in claim 1, wherein the first signal processing unit comprises:

a first transistor having a gate electrode for receiving the sub input signal, a first electrode coupled to a first node, and a second electrode coupled to a ground power source;

a second transistor having a gate electrode for receiving the main input signal, a first electrode coupled to the first node, and a second electrode coupled to a driving power source;

a third transistor having a gate electrode coupled to the first node, a first electrode coupled to the driving power source, and a second electrode;

a fourth transistor having a gate electrode coupled to the first node, a first electrode coupled to the second electrode of the third transistor, and a second electrode coupled to a second node; and a fifth transistor having a gate electrode for receiving the main input signal, a first electrode coupled to the second node, and a second electrode coupled to a ground power source, wherein the first output signal is output to the first node, and wherein the second output signal is output to the second node.

4. The scan driver as claimed in claim 1, wherein the second signal processing unit comprises:

a first transistor having a gate electrode coupled to a first node of the first signal processing unit, a first electrode coupled to a driving power source, and a second electrode coupled to a third node;

a second transistor having a gate electrode coupled to a second node of the first signal processing unit, a first electrode coupled to the third node, and a second electrode for receiving a clock signal; and a first capacitor coupled between the second node and the third node, wherein the scan signal is output to the third node.

5. The scan driver as claimed in claim 1, wherein the third signal processing unit comprises:

a first transistor having a gate electrode coupled to a second node of the first signal processing unit, a first electrode coupled to a driving power source, and a second electrode coupled to a fourth node;

a second transistor having a gate electrode coupled to a first node of the first signal processing unit, a first electrode coupled to the fourth node, and a second electrode coupled to a ground power source; and a first capacitor coupled between the first node and the fourth node, wherein an emission control signal is output to the fourth node.

6. An organic light emitting display, comprising:

a display unit comprising pixels coupled to scan lines, emission control lines, data lines, a first power source, and a second power source;

a scan driver comprising a plurality of stages coupled to the scan lines and the emission control lines to provide scan signals and emission control signals to the pixels through the scan lines and the emission control lines; and a data driver for supplying data signals to the pixels through the data lines, wherein each of the stages comprises:

a first signal processing unit for receiving a main input signal and a sub input signal to output a first output signal and a second output signal, wherein each of the first and second output signals is generated according to both of the main input signal and the sub input signal;

a second signal processing unit for receiving the first output signal, the second output signal, and a clock signal to output a scan signal; and a third signal processing unit for receiving the first output signal and the second output signal to output an emission control signal, wherein a width of the emission control signal is controlled using the main input signal and the sub input signal.

7. The organic light emitting display as claimed in claim 6, wherein each of the signal processing units is coupled to a driving power source and a ground power source.

8. The organic light emitting display as claimed in claim 6, wherein a scan signal output from an ith stage is configured to be supplied as the main input signal of an (i+1)th stage, wherein i is a natural number.

9. The organic light emitting display as claimed in claim 6, wherein the first signal processing unit comprises:

a first transistor having a gate electrode for receiving the sub input signal, a first electrode coupled to a first node, and a second electrode coupled to a ground power source;

a second transistor having a gate electrode for receiving the main input signal, a first electrode coupled to the first node, and a second electrode coupled to a driving power source;

a third transistor having a gate electrode coupled to the first node, a first electrode coupled to a driving power source, and a second electrode;

a fourth transistor having a gate electrode coupled to the first node, a first electrode coupled to the second electrode of the third transistor, and a second electrode coupled to a second node; and a fifth transistor having a gate electrode for receiving the main input signal, a first electrode coupled to the second node, and a second electrode coupled to a ground power source, wherein the first output signal is output to the first node, and wherein the second output signal is output to the second node.

10. The organic light emitting display device as claimed in claim 6, wherein the second signal processing unit comprises:

a first transistor having a gate electrode coupled to a first node of the first signal processing unit, a first electrode coupled to a driving power source, and a second electrode coupled to a third node;

a second transistor having a gate electrode coupled to a second node of the first signal processing unit, a first electrode coupled to the third node, and a second electrode for receiving a clock signal; and a first capacitor coupled between the second node and the third node, wherein the scan signal is output to the third node.

11. The organic light emitting display as claimed in claim 6, wherein the third signal processing unit comprises:

a first transistor having a gate electrode coupled to a second node of the first signal processing unit, a first electrode coupled to a driving power source, and a second electrode coupled to a fourth node;

a second transistor having a gate electrode coupled to a first node of the first signal processing unit, a first electrode coupled to the fourth node, and a second electrode coupled to a ground power source; and a first capacitor coupled between the first node and the fourth node, wherein an emission control signal is output to the fourth node.

* * * * *